US008727480B2

(12) United States Patent
Yoshiike

(10) Patent No.: US 8,727,480 B2
(45) Date of Patent: May 20, 2014

(54) LIQUID DISCHARGE HEAD AND IMAGE FORMING APPARATUS

(71) Applicant: Masataka Yoshiike, Kanagawa (JP)

(72) Inventor: Masataka Yoshiike, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/753,741

(22) Filed: Jan. 30, 2013

(65) Prior Publication Data

US 2013/0208047 A1 Aug. 15, 2013

(30) Foreign Application Priority Data

Feb. 10, 2012 (JP) ..... 2012-027055

(51) Int. Cl.
*B41J 2/235* (2006.01)
*B41J 2/165* (2006.01)
*B41J 2/16* (2006.01)

(52) U.S. Cl.
CPC ..... *B41J 2/1623* (2013.01)
USPC ..... 347/22; 347/29

(58) Field of Classification Search
CPC ..... B41J 2/1623
USPC ..... 347/22, 29
See application file for complete search history.

(56) References Cited

U.S. PATENT DOCUMENTS

| | | | | |
|---|---|---|---|---|
| 6,045,216 | A | 4/2000 | Sasaki | |
| 8,061,813 | B2 | 11/2011 | Matsuzawa et al. | |
| 2003/0081050 | A1 * | 5/2003 | Reed et al. | 347/29 |
| 2006/0164467 | A1 * | 7/2006 | Shibuya et al. | 347/70 |

FOREIGN PATENT DOCUMENTS

| | | |
|---|---|---|
| JP | 9-66607 | 3/1997 |
| JP | 2006-51746 | 2/2006 |
| JP | 4228239 | 2/2009 |
| JP | 2009-45884 | 3/2009 |
| JP | 2009-214303 | 9/2009 |

* cited by examiner

*Primary Examiner* — Stephen Meier
*Assistant Examiner* — Alexander D Shenderov
(74) *Attorney, Agent, or Firm* — Cooper & Dunham LLP

(57) ABSTRACT

Disclosed is a liquid discharge head including a nozzle plate including plural nozzles that discharge liquid droplets; a flow channel member that forms plural individual liquid chambers, the plural individual liquid chambers communicating with the corresponding nozzles; and a frame member that forms a common liquid chamber that supplies a liquid to the plural individual liquid chambers. The frame member covers a first outer circumferential surface of the nozzle plate and a second outer circumferential surface of the flow channel member. The frame member includes a protecting portion that covers a peripheral portion of a surface of the nozzle plate, where the protecting portion is made molten and adhered to the surface of the nozzle plate.

8 Claims, 10 Drawing Sheets

LIQUID DISCHARGE HEAD AND IMAGE FORMING APPARATUS

BACKGROUND OF THE INVENTION

1. Field of the Invention

Embodiments of the present invention relate to a liquid discharge head and an image forming apparatus.

2. Description of the Related Art

As an image forming apparatus, such as a printer, a facsimile machine, a copier, a plotter, and a multifunctional peripheral thereof, a liquid discharge recording type image forming apparatus has been known. In the liquid discharge recording type image forming apparatus, such as an inkjet recording apparatus, a recording head including a liquid discharge head (a droplet discharge head) is utilized.

Such an image forming apparatus usually includes a recovering mechanism. The recovering mechanism removes residual ink and adhering substances by wiping a surface of a nozzle plate (a nozzle surface) of a liquid discharge head.

In order to protect side surfaces of a nozzle plate and a flow channel member from penetration of ink or from physical contact from outside, a nozzle cover (a nozzle protection member) may be attached to a liquid discharge head.

For some liquid discharge heads, a frame member that forms an outer circumferential surface of a head is utilized as a nozzle plate protection member. In this case, in order to reduce the cost for components, individual nozzle covers are not provided.

For example, a liquid discharge head has been known such that a portion of a frame member covers a peripheral portion of a bounded surface of a nozzle plate of a flow channel plate. The liquid discharge head has a configuration such that an outer circumferential surface of the nozzle plate faces an internal circumference of a peripheral portion of an opening of a frame member (cf. Patent Document 1). As another example, a liquid discharge head has been known such that slit-shaped openings are formed in an outer periphery surface of a frame member, and protruding portions which have been formed at corresponding four sides of a nozzle plate are inserted into the slit-shaped openings. In the liquid discharge head, the frame member functions as a protection member for protecting the nozzle plate (cf. Patent Document 2).

Further, a liquid discharge head has been known such that the liquid discharge head includes a housing that covers a side surface of a head chip. In the liquid discharge head, a sealing member or the housing is made molten and adhered to the side surface of the head chip, thereby filling a gap between the side surface of the head chip and the housing (cf. Patent Document 3).

Patent Document 1: Japanese Patent Laid-Open Application No. 2006-51746

Patent Document 2: Japanese Patent Laid-Open Application No. 2009-214303

Patent Document 3: Japanese Patent Laid-Open Application No. H09-66607

However, in the configuration disclosed in Patent Document 1, the outer circumferential surface of the nozzle plate is not joined to the internal circumference of the peripheral portion of the opening of the frame member. In this case, a gap may occur between the outer circumferential surface of the nozzle plate and the internal circumference of the peripheral portion of the opening of the frame member. Therefore, there is a problem such that a liquid (waste liquid) that is removed by the wiping operation penetrates the gap, and thereby the waste liquid accumulates on the nozzle surface.

Further, in the configuration disclosed in Patent Document 2, since the protruding portions of the nozzle plate are inserted into the slit-shaped openings, a gap and a level difference may occur between the nozzle surface and a portion covered with the frame member. In this case, the portion having the level difference may be filled with a sealant. However, in general, water-repellent processing has been performed on the nozzle surface. Therefore, adhesiveness between the sealant and the nozzle surface is weakened with time, and it is possible that a gap occurs between the frame member and the nozzle surface. Accordingly, similar to the case of Patent Document 1, there is a problem such that a liquid (waste liquid) removed by the wiping operation penetrates into the gap, and the waste liquid is accumulated on the nozzle surface.

Further, in the configuration disclosed in Patent Document 3, the joining portion between the head chip and the housing is on the side of the head chip. Therefore, there is a problem that a peripheral portion of the nozzle plate may not be protected.

SUMMARY OF THE INVENTION

The embodiments of the present invention have been developed in view of the above-described problems. An objective of the present invention is to reduce the number of components, while enabling regulation of the accumulation of the waste liquid on the nozzle surface.

In one aspect of the present invention, there is provided a liquid discharge head including a nozzle plate including plural nozzles configured to discharge liquid droplets;

a flow channel member configured to form plural individual liquid chambers, the plural individual liquid chambers communicating with the corresponding nozzles;

a frame member configured to form a common liquid chamber that supplies a liquid to the plural individual liquid chambers, wherein the frame member is configured to cover a first outer circumferential surface of the nozzle plate and a second outer circumferential surface of the flow channel member, wherein the frame member includes a protecting portion that covers a peripheral portion of a surface of the nozzle plate, and wherein the protecting portion is made molten and adhered to the surface of the nozzle plate.

In another aspect of the present invention, there is provided an image forming apparatus including a liquid discharge head, wherein the liquid discharge head includes a nozzle plate including plural nozzles configured to discharge liquid droplets;

a flow channel member configured to form plural individual liquid chambers, the plural individual liquid chambers communicating with the corresponding nozzles;

a frame member configured to form a common liquid chamber that supplies a liquid to the plural individual liquid chambers, wherein the frame member is configured to cover a first outer circumferential surface of the nozzle plate and a second outer circumferential surface of the flow channel member, wherein the frame member includes a protecting portion that covers a peripheral portion of a surface of the nozzle plate, and the protecting portion is made molten and adhered to the surface of the nozzle plate.

In another aspect of the present invention, there is provided an image forming apparatus including a liquid discharge head including a nozzle plate, the nozzle plate including plural nozzles configured to discharge liquid droplets; and a wiper member configured to wipe a surface of the nozzle plate, wherein the liquid discharge head includes a flow channel member configured to form plural individual liquid chambers, the plural individual liquid chambers communicating with the corresponding nozzles; and a frame member configured to form a common liquid chamber that supplies a liquid to the plural individual liquid chambers, wherein the frame member is configured to cover a first outer circumferential surface of the nozzle plate and a second outer circumferential surface of the flow channel member, wherein the frame member includes a protecting portion that covers a peripheral portion of the surface of the nozzle plate, wherein the protecting portion is made molten and adhered to the surface of the nozzle plate, and wherein in a first surface of the protecting portion, the first surface at a side from which the wiper member starts contacting is inclined such that the first surface is separated from the surface of the nozzle plate in an opposite direction, the opposite direction being opposite to a liquid discharging direction, along a first direction from an internal circumferential edge to an outer circumference of the frame member, wherein the internal circumferential edge covers the surface of the nozzle plate.

With the liquid discharge head according to the embodiments of the present invention, the number of the components can be reduced, while regulating the accumulation of the waste liquid on the nozzle surface.

Other objects, features and advantages of the present invention will become more apparent from the following detailed description when read in conjunction with the accompanying drawings.

DETAILED DESCRIPTION OF THE PREFERRED EMBODIMENTS

Figure 1:
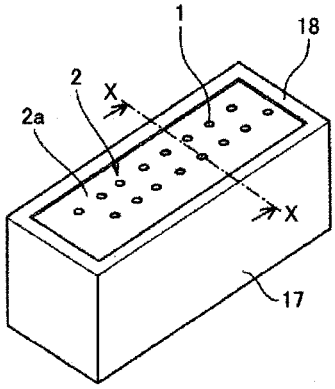
FIG. 1 is an external perspective view illustrating a liquid discharge head according to a first embodiment of the present invention.
Figure 2:
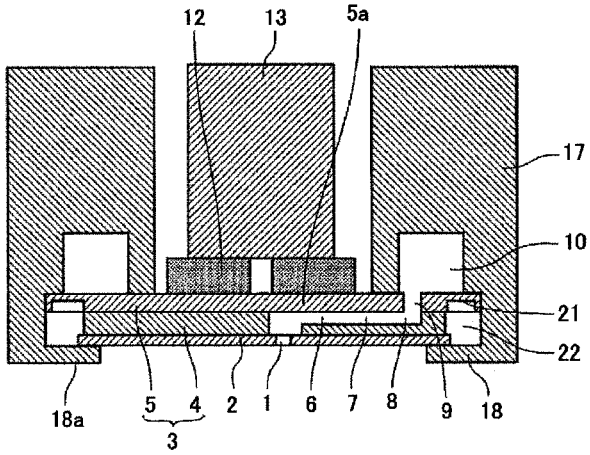
FIG. 2 is a cross-sectional view illustrating the liquid discharge head according to the first embodiment in a direction along an X-X line in FIG. 1 and perpendicular to a nozzle arranging direction.

Hereinafter, embodiments of the present invention are explained by referring to the accompanying drawings. First, there is explained a liquid discharge head according to a first embodiment by referring to FIGS. 1 and 2. FIG. 1 is a perspective view illustrating the liquid discharge head according to the first embodiment. FIG. 2 is a cross-sectional view illustrating the liquid discharge head according to the first embodiment in a direction along an X-X line in FIG. 1 and perpendicular to a nozzle arranging direction (a longitudinal direction of a liquid chamber).

In the liquid discharge head, a nozzle plate 2 in which nozzles 1 for discharging liquid droplets are formed and a flow channel member 3 formed of a flow channel plate 4 and an oscillation plate member 5 are laminated and joined together. The flow channel member 3 forms plural liquid chambers 6 (also referred to as a "pressurized liquid chamber," a "pressure chamber," a "compression chamber," and a "fluid channel"); a fluid resistance portion 7 that also functions as a supply channel for supplying ink to the liquid chamber 6; and a liquid introducing portion 8 that is connected to the liquid chamber 6 through the fluid resistance portion 7.

Then, a liquid is supplied from a common liquid chamber 10 to the liquid introducing portion 8 through a supply port 9. The common liquid chamber 10 is formed in a frame member 17 which also functions as a common liquid chamber member (described later). The supply port 9 is formed in the oscillation plate member 5. Further, the liquid is supplied to the liquid chamber 6 through the fluid resistance portion 7.

The nozzle plate 2 is formed of a nickel (Ni) metal plate. The nozzle plate 2 has been produced by an electroforming process. In the nozzle plate 2, the nozzles 1 having a diameter in a range from 10 μm to 35 μm have been formed. The nozzles 1 correspond to the liquid chambers 6. The nozzle plate 2 is joined to the flow channel plate 4 of the flow channel member 3 by a bonding agent. A water-repellent layer is formed on a droplet discharging surface (a surface in a discharging direction: a discharge surface, or a surface opposite to the liquid chamber 6) of the nozzle plate 2.

The flow channel plate 4 of the flow channel member 3 is formed of a silicon substrate. Groove portions and openings of the liquid chamber 6 and the fluid resistance portion 7 have been formed by etching the silicon substrate. Alternatively, the flow channel plate 4 may be formed by etching a stainless steel substrate by using an acid etching liquid, for example. Additionally, the flow channel plate 4 may be formed by mechanically processing a stainless steel substrate, for example by applying a punching process to the stainless steel substrate.

The oscillation plate member 5 is a wall surface member which forms wall surfaces of the liquid chamber 6, the fluid resistance portion 7, the liquid introducing portion 8, and the like. The oscillation plate member 5 includes an oscillation region 5*a* which is a portion of the wall surface of the liquid chamber 6. A piezoelectric member (piezoelectric element) 12 is joined to the oscillation region 5*a*. The piezoelectric member 12 is a part of an actuator unit (a pressure generating unit). Here, the actuator unit is not limited to the piezoelectric actuator. A thermal actuator or an electrostatic actuator may be utilized.

As a piezoelectric member 12, a laminated type piezoelectric member is utilized. The laminated type piezoelectric member 12 is joined to a base member (not shown), and on the laminated type piezoelectric member, grooves are formed by half-cut dicing. Further, in the laminated type piezoelectric member, plural piezoelectric poles are arranged in a comb-shape, while the plural piezoelectric poles are evenly spaced apart. The piezoelectric member 12 is joined to the base member 13. A flexible printed circuit (FPC) (not shown) and the like are connected to the piezoelectric member 12.

A frame member 17 is joined to a side of an outer circumference of the piezoelectric actuator formed of the piezoelectric member 12, the base member 13, the flexible printed circuit board, and the like. The frame member 17 is formed of a resin member, such as an epoxy based resin.

In the frame member 17, the above-described common liquid chamber 10 is formed. Further, in the frame member 17, a supply port is formed. The supply port is for supplying a recording liquid to the common liquid chamber 10 from outside. The supply port is connected to an ink supply source such as a sub-tank (not shown) or an ink cartridge (not shown).

In the frame member 17, a protecting portion 18 is integrally formed. The protecting portion 18 covers a peripheral portion of surface 2*a* of the nozzle plate 2 (hereinafter, referred to as the "nozzle surface 2*a*"). The protecting portion 18 is made molten and then adhered to the peripheral portion of the nozzle surface 2*a*.

Further, a deformable region (a damper region) 21 which forms a portion of the wall surface of the common liquid chamber 10 is formed in the oscillation plate member 5. Further, in the oscillation plate member 5, a damper chamber 22 is formed. The damper chamber 22 is surrounded by end portions of the frame member 17, the nozzle plate 2, and the flow channel member 3.

As described above, the protecting portion 18 that covers the peripheral portion of the nozzle surface 2*a* is integrally formed in the frame member 17. Therefore, the number of the components can be reduced, compared to a case where a nozzle cover is separately provided.

As further described above, the protecting portion 18 is made molten and adhered to the nozzle surface 2*a*. The resin material of the protecting portion 18 adheres to the nozzle surface 2*a*, while the resin material closely follows the irregularities of the nozzle surface 2*a*. Therefore, there are no gaps between the nozzle surface 2*a* and the protecting portion 18. Accordingly, the waste ink that has been wiped during wiping does not penetrate the boundary between the nozzle surface 2*a* and the protecting portion 18, and the accumulation of the waste liquid on the nozzle surface 2*a* can be regulated. Therefore, cleanliness of the nozzle surface 2*a* can be improved.

Figure 3:
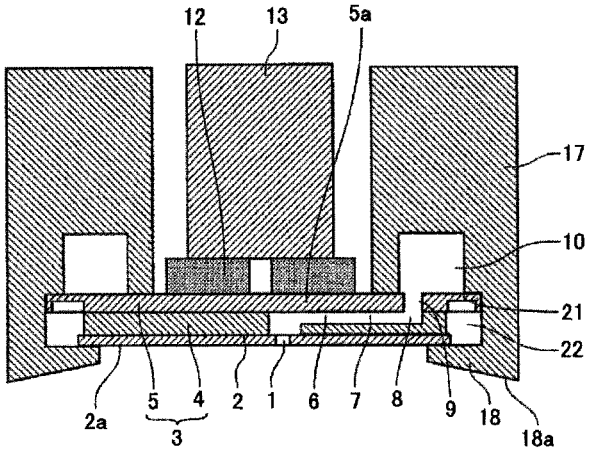
FIG. 3 is a cross-sectional view similar to that of FIG. 2 illustrating a liquid discharge head according to a second embodiment of the present invention.

Next is explained a liquid discharge head according to a second embodiment by referring to FIG. 3. Similar to FIG. 2, FIG. 3 is a cross-sectional view illustrating the liquid discharge head.

In the second embodiment, a surface 18*a* of the protecting portion 18 of the frame member 17 is formed such that the surface 18*a* is inclined, so that the surface 18*a* is farther separated from the nozzle surface 2*a* in the direction in which the liquid droplets are discharged, along the direction from an internal circumferential edge that covers the peripheral part of the nozzle surface 2*a* to the outer circumference of the frame member 17.

In this manner, when the wiping is completed, the waste liquid that has been moved to a wiper member is collected at a base side of the wiper member. A small amount of the waste liquid remains at the tip of the wiper member. Further, since an original shape of the wiper member is gradually recovered, it is possible to lower a likelihood that the waste liquid that has been moved to the wiper member is thrown out.

Figure 4:
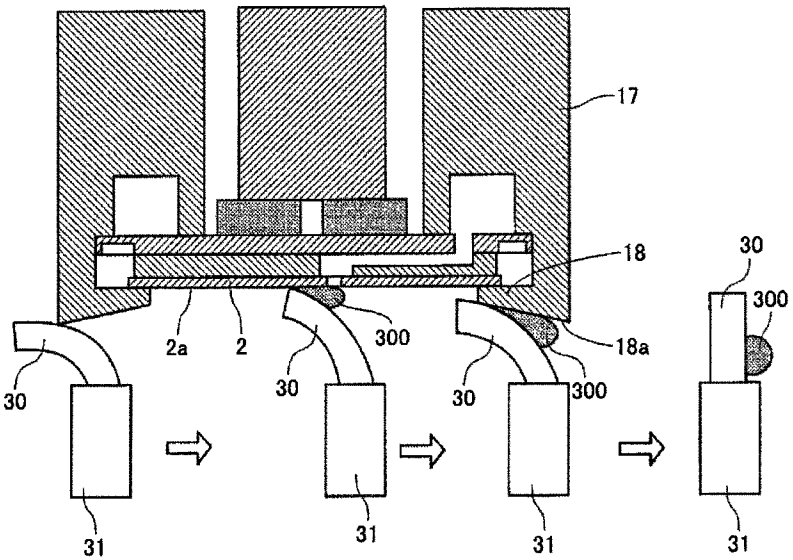
FIG. 4 is a cross-sectional view illustrating an effect of the liquid discharge head according to the second embodiment.

Namely, as shown in FIG. 4, for example, when a wiper member 30 fixed to a wiper holder 31 moves relative to the nozzle surface 2*a* in the longitudinal direction of the liquid chamber, the wiper member 30 wipes the nozzle surface 2*a* from one end to the other end in a direction indicated by the white arrows. At this time, the wiper member 30 wipes the nozzle surface 2*a*, while the wiper member 30 is bent by elastic deformation.

When the wiper member 30 that has contacted the nozzle surface 2*a* subsequently contacts the surface 18*a* of the protecting portion 18, and the wiper member 30 moves along the slope of the protecting portion 18, waste liquid 300 that has been collected by the wiper member 30 is guided from the tip side to the base side (the side of the wiper holder 31), and thereby an adhering amount of the waste liquid at the tip side is reduced.

In this manner, the tip portion of the wiper member 30 that may contact the nozzle surface 2*a* in the next wiping operation can be cleaned, and the maintenance becomes easier.

Further, since the surface 18*a* of the protecting portion 18 is inclined such that the surface 18*a* is gradually separated from the nozzle surface 2*a*, the original shape of the wiper member 30 is gradually recovered. When the wiper member 30 is separated from the protecting portion 18, an amount of deformation of the wiper member 30 to recover the original shape is small. As described above, since the adhering amount of the waste liquid 300 to the tip portion of the wiper member 30 is small, an amount of the waste liquid 300 that is thrown out during recovering the original shape is small.

Figure 5:
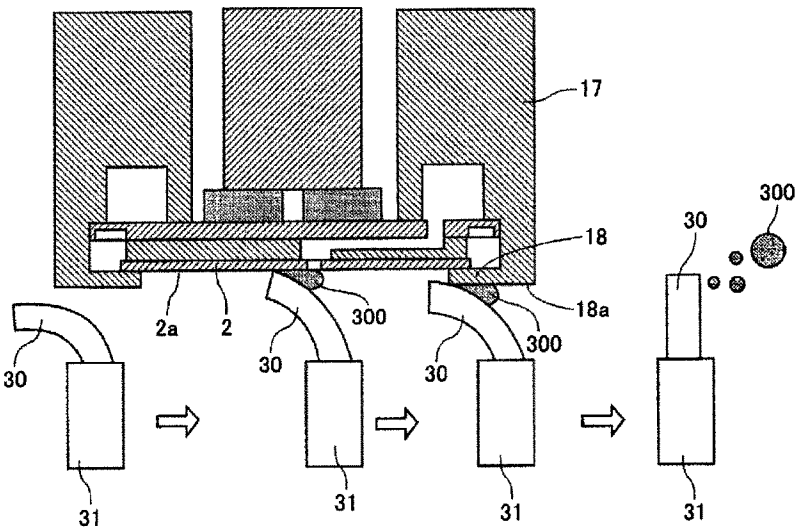
FIG. 5 is a cross-sectional view illustrating an effect of the liquid discharge head according to the first embodiment, by comparing the liquid discharge head according to the first embodiment and the liquid discharge head according to the second embodiment.

On the other hand, in the configuration according to the first embodiment, the surface 18*a* of the protecting portion 18 of the frame member 17 is formed substantially in parallel with the nozzle surface 2*a*. Therefore, as shown in FIG. 5, when the wiping of the nozzle surface 2*a* has been completed and the wiper member 30 is separated from the surface 18*a* of the protecting portion 18, it is possible that the waste liquid 300 that has been adhered to the wiper member 30 may be thrown out by the wiper member 30 which is recovering the original shape.

It is preferable that an inclination angle of the surface 18*a* of the protecting portion 18 be such that, when the surface 18*a* is gradually inclined from the horizontal state, the waste liquid 300 that is adhered to the surface 18*a* in the horizontal state starts moving at the inclination angle.

Figure 6:
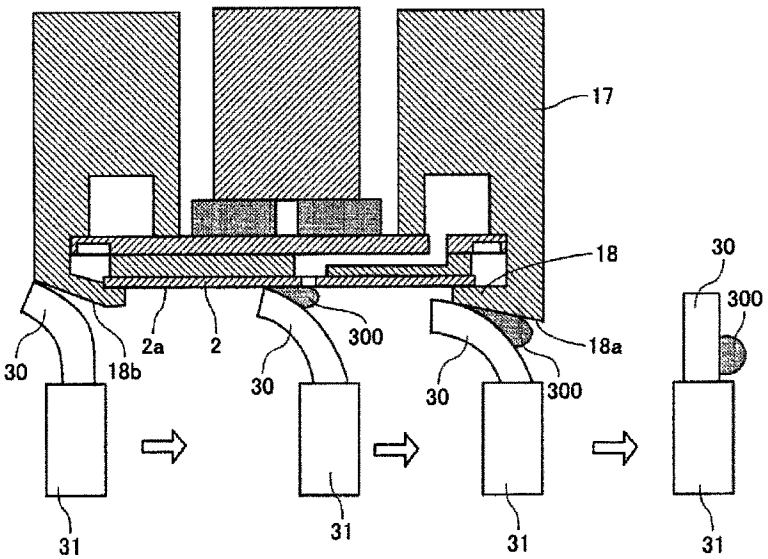
FIG. 6 is a cross-sectional view similar to that of FIG. 2 illustrating a liquid discharge head according to a third embodiment of the present invention.

Next, there is explained a liquid discharge head according to a third embodiment by referring to FIG. 6. Similar to FIG. 2, FIG. 6 is a cross-sectional view illustrating the liquid discharge head according to the third embodiment.

In the third embodiment, a surface 18*b* of the protecting portion 18 of the frame member 17, which surface 18*b* is at a side from which the wiper member 30 that wipes the nozzle surface 2*a* starts contacting, is inclined such that the surface 18*b* becomes closer to the nozzle surface 2*a* along a direction from the side of the outer circumference of the frame member 17 to an outer circumferential edge of the nozzle plate 2.

Namely, in the protecting portion 18, the surface 18*b* at the side from which the wiper member 30 that wipes the nozzle surface 2*a* starts contacting is inclined such that the surface 18*b* is separated from the nozzle surface 2*a* in the direction opposite to the liquid droplet discharge direction along a direction from the internal circumferential edge that covers the peripheral portion of the nozzle surface 2*a* to the side of the outer circumference of the frame member 17.

With such a configuration, contact pressure applied to the wiper member 30 gradually increases from the beginning of contacting the protecting portion 18 by the wiper member 30 until the wiper member 30 reaches the nozzle surface 2*a*. Therefore, the stress applied to the wiper member 30 is reduced, and the nozzle surface 2*a* is stably wiped.

Figure 7:
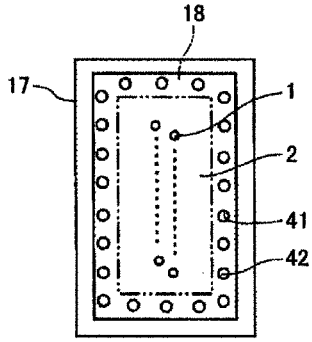
FIG. 7 is a plan view illustrating a liquid discharge head according to a fourth embodiment.
Figure 8:
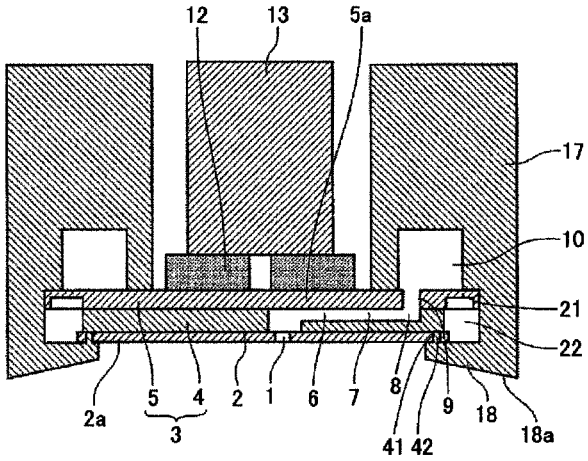
FIG. 8 is a cross-sectional view similar to that of FIG. 2 illustrating the liquid discharge head according to the fourth embodiment.

Next is explained a liquid discharge head according to the fourth embodiment by referring to FIGS. 7 and 8. FIG. 7 is a plan view illustrating the liquid discharge head according to the fourth embodiment. Similar to FIG. 2, FIG. 8 is a cross-sectional view illustrating the liquid discharge head according to the fourth embodiment. In FIG. 7, an inner periphery of the protecting portion 18 is transparently shown.

In the fourth embodiment, in an area at which the protection portion 18 of the frame member 17 and the nozzle surface 2*a* are adhered to each other, plural through holes 41 are formed in the nozzle plate 2 along the periphery of the nozzle surface 2*a*, while the plural through holes 41 are arranged in lines.

With such a configuration, when the protecting portion 18 of the frame member 17 is made molten and adhered to the peripheral portion of the nozzle surface 2*a*, the molten resin penetrates into the through holes 41, thereby forming pillars 42.

In this case, even if a difference in level between the protecting portion 18 and the nozzle surface 2*a* is reduced, the pillars 42 formed inside the through holes 41 function as anchors to reinforce the bonding strength between the protecting portion 18 and the nozzle plate 2, thereby preventing the protecting portion 18 from being removed from the nozzle surface 2*a* by the wiper member 30, for example.

Further, since there are pillars 42 formed inside the corresponding through holes 41, even if a gap is formed between the nozzle plate 2 and the protecting portion 18, a liquid is prevented from immediately penetrating into a functional portion (a damper portion) and a joining portion.

Figure 9:
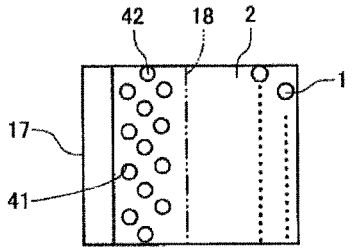
FIG. 9 is a plan view magnifying and illustrating a liquid discharge head according to a fifth embodiment of the present invention.

Next, there is explained a liquid discharge head according to a fifth embodiment of the present invention by referring to FIG. 9. FIG. 9 is a plan view magnifying and illustrating the liquid discharge head according to the fifth embodiment.

In the fifth embodiment, the plural through holes 41 according to the fourth embodiment are arranged in a staggered manner.

With this configuration, the bonding strength between the nozzle plate 2 and the protecting portion 18 is further reinforced. Therefore, penetration of the liquid is further reduced.

Figure 10A:
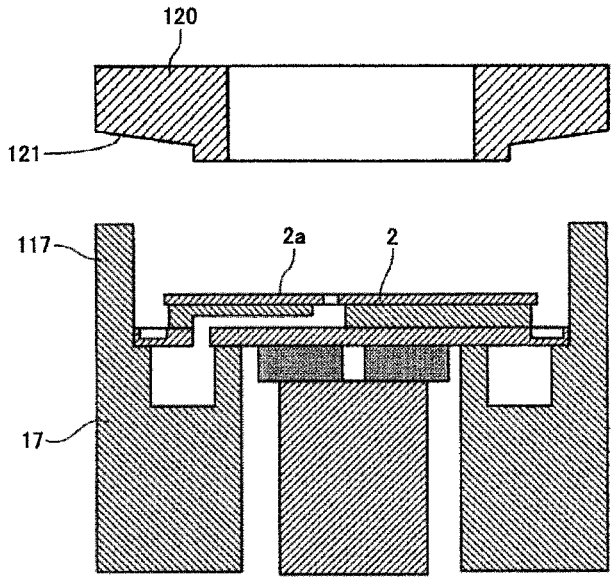
FIGS. 10A and 10B are cross-sectional views illustrating a manufacturing method of the liquid discharge head according to one of the embodiments of the present invention.
Figure 10B:
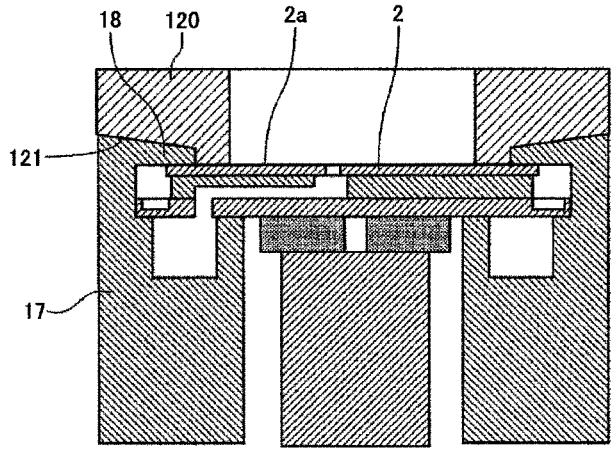

Next, there is explained a method of manufacturing the liquid discharge head according to one embodiment by referring to FIGS. 10A and 10B. FIGS. 10A and 10B are cross-sectional views illustrating the method of manufacturing the liquid discharge head.

As shown in FIG. 10A, the frame member 17 is provided with a rib 117. The rib 117 is to be processed to form the protecting portion 18. The frame member 17 is formed of a resin material, such as a thermoplastic resin. When a high fluidity resin, such as a poly phenylene sulfide (PPS) resin, is utilized, the processing becomes easier.

A horn 120 that melts the rib 117 by heat or ultrasonic waves is pressed to the rib 117 of the frame member 17 from a side facing the nozzle plate 2 by applying pressure. At this time, the horn 120 is pressed to the rib 117 which is formed of the resin, while the horn 120 melts the rib 117 by heat.

Subsequently, as shown in FIG. 10B, when the horn 120 contacts the nozzle surface 2*a*, the shape of the protecting portion 18 is formed by filling a space surrounded by the horn 120 and the nozzle surface 2*a* with the molten resin.

Since the molten resin closely follows the small irregularities of the nozzle surface 2*a*, there are no gaps between the nozzle surface 2*a* and the protecting portion 18.

Further, a pressing surface 121 of the horn 120 has a mirror finish. Therefore, the surface of the molten resin is pressed to the mirror surface, and the surface 18*a* of the protecting portion 18 becomes a mirror surface.

Since the surface 18*a* of the protecting portion 18 is the mirror surface, when the surface 18*a* of the protecting portion 18 is wiped by the wiper member 30, the waste liquid adhering to the surface 18*a* is easily wiped, and a residual portion left uncleaned is reduced. Further, contact resistance between the wiper member 30 and the surface 18*a* of the protecting portion 18 is lowered, and thereby the wiping performance is improved.

Further, by changing the shape of the press-contacting portion (sculptured portion) of the horn 120, the shape of the protecting portion 18 may be arbitrarily changed.

Here, by integrating the above-described liquid discharge head and a tank that supplies the liquid to the liquid discharge head, a liquid cartridge integrating a head (or a head integrating a cartridge) can be obtained.

Figure 11:
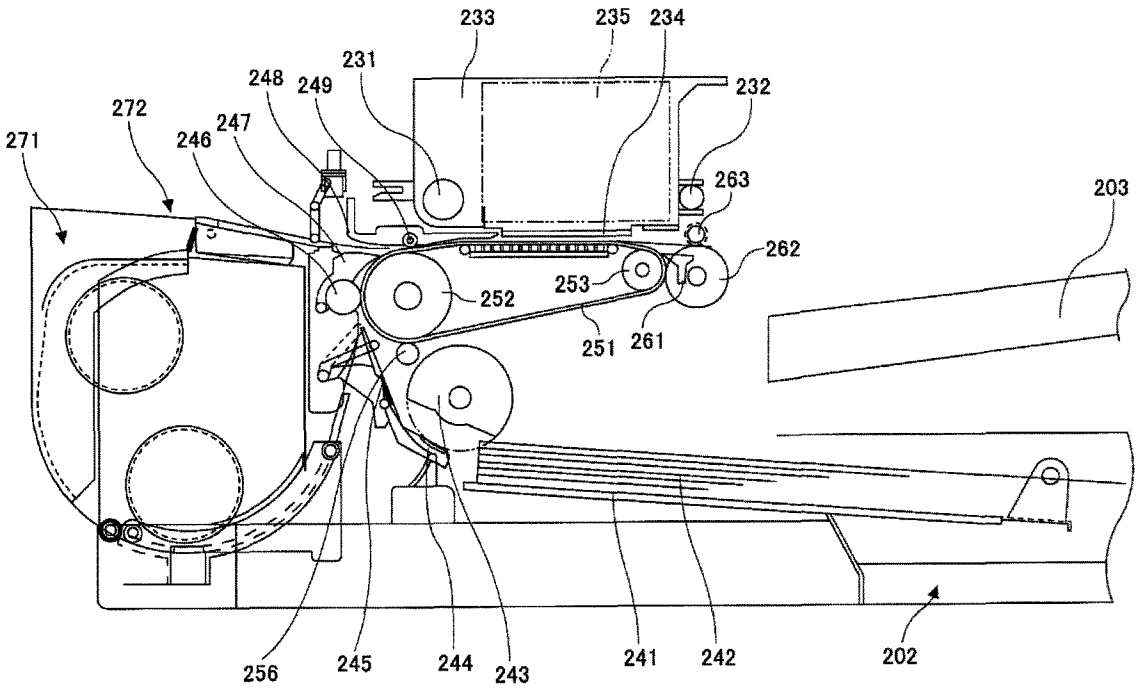
FIG. 11 is a side view illustrating mechanical portions of an image forming apparatus according to one of the embodiments of the present invention.
Figure 12:
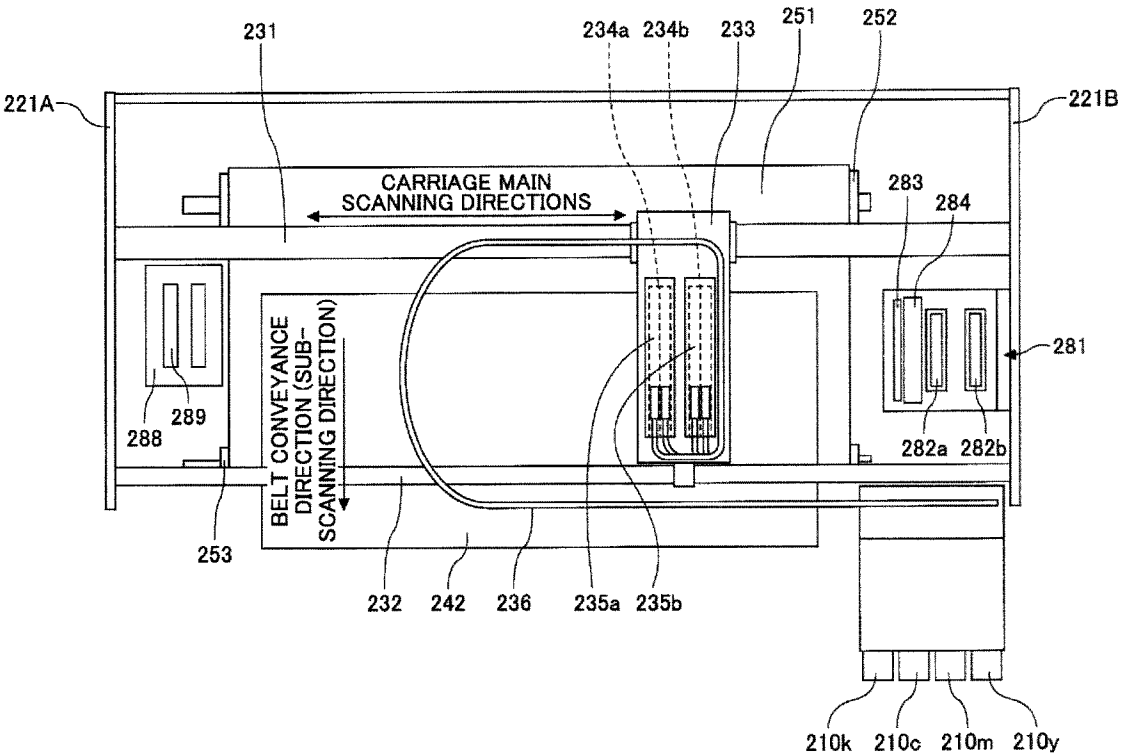
FIG. 12 is a plan view illustrating major portions of the mechanical portions of the image forming apparatus according to one of the embodiments of the present invention.

Next is explained an example of an image forming apparatus including a liquid discharge head according to one of the embodiments by referring to FIGS. 11 and 12. FIG. 11 is a schematic side view illustrating mechanical portions of the image forming apparatus. FIG. 12 is a plan view illustrating major portions the mechanical portions of the image forming apparatus.

The image forming apparatus is a serial-type image forming apparatus. A carriage 233 is supported by a main guide rod 231 and a sub guide rod 232, so that the carriage 233 can be slid in a main scanning direction. The main guide rod 231 and the sub guide rod 232 are horizontally supported by a left side plate 221A and a right side plate 221B. The carriage 233 is moved by a main scanning motor (not shown) through a timing belt in directions indicated by the arrows in FIG. 12 (carriage main scanning directions) while scanning.

A recording head 234 formed of the liquid discharge heads for discharging yellow (Y) ink, cyan (C) ink, magenta (M) ink, and black (K) ink according to one of the embodiments of the present invention is attached to the carriage 233, while nozzle sequences formed of plural nozzles are arranged in a sub-scanning direction which is perpendicular to the main scanning direction and the ink droplet discharging direction is downward.

The recording head 234 is formed by attaching a liquid discharge head 234*a* and a liquid discharge head 234*b* to one base member. The liquid discharge head 234*a* has two nozzle sequences. The liquid discharge head 234*b* has two nozzle sequences. One of the nozzle sequences of the head 234*a* discharges black (K) liquid droplets, and the other nozzle sequence of the head 234*a* discharges cyan (C) liquid droplets. One of the nozzle sequences of the head 234*b* discharges magenta (M) liquid droplets, and the other nozzle sequence of the head 234*b* discharges yellow (Y) liquid droplets. Here, the liquid droplets of the four colors are discharged by the combination of the two heads 234*a* and 234*b*. However, four liquid discharge heads that discharge the corresponding four colors of liquid droplets may be included in the recording head 234.

Further, the carriage 233 includes sub-tanks 235*a* and 235*b* (when the sub-tanks 235*a* and 235*b* are not distinguished, they are referred to as "the sub-tanks 235") for supplying the corresponding colors of ink to the recording head 234. The yellow ink is supplied from a yellow ink cartridge 210*y* to the corresponding sub-tank 235 through a supply tube 236 for the yellow ink by a supply unit (not shown). The magenta ink is supplied from a magenta ink cartridge 210*m* to the corresponding sub-tank 235 through a supply tube 236 for the magenta ink by the supply unit (not shown). The cyan ink is supplied from a cyan ink cartridge 210*c* to the corresponding sub-tank 235 through a supply tube 236 for the cyan ink by the supply unit (not shown). The black ink is supplied from a black ink cartridge 210*k* to the corresponding sub-tank 235 through a supply tube 236 for the black ink by the supply unit (not shown).

On the other hand, as a paper feeding unit for feeding sheets of paper 242 stacked on a paper stacking unit (platen) 241 of a paper feed tray 202, the image forming apparatus includes a half-moon roller (paper feed roller) 243 for feeding the sheets of the paper 242 from the paper stacking unit 241 on a sheet-by-sheet basis, and a separation pad 244 formed of a material having a high coefficient of friction that faces the paper feed roller 243. The separation pad 244 is pressed toward the paper feed roller 243.

In order to convey the sheet 242 that has been fed from the paper feeding unit to a portion below the recording head 234, the image forming apparatus further includes a guide 245 for guiding the sheet 245; a counter roller 246; a conveyance guide 247; and a pressing member 248 including a tip pressing roller 249. Further, the image forming apparatus includes a conveyance belt 251 that electrostatically attracts the sheet 242 that has been fed and conveys the sheet 242 to the portion facing the recording head 234.

The conveyance belt 251 is an endless-shaped belt. The conveyance belt 251 is wound around a conveyance roller 252 and a tension roller 253. The conveyance belt 251 circulates in a belt conveyance direction (the sub-scanning direction). Further, the image forming apparatus includes a charging roller 256 for electrically charging the surface of the conveyance belt 251. The charging roller 256 contacts the surface of the conveyance belt 251, so that the charging roller 256 is rotated by the rotation of the conveyance belt 251. The conveyance belt 251 circulates in the belt conveyance direction as the conveyance roller 252 is rotated by a sub-scanning motor (not shown).

Further, the image forming apparatus includes, as a paper discharge unit for discharging the sheet 242 on which an image has been recorded by the recording head 234, a separation pawl 261 for separating the sheet 242 from the conveyance belt 251; paper discharge rollers 262 and 263; and a paper discharge tray 203 disposed below the paper discharge roller 262.

Further, a double-side unit 271 is detachably attached to a rear side of the main body of the image forming apparatus. The double-side unit 271 takes in the sheet 242 that is returned by reverse rotation of the conveyance belt 251. Subsequently, the double-side unit 271 inverts the sheet 242 and feeds the sheet 242 between the counter roller 246 and the conveyance belt 251. Here, the top surface of the double-side unit 271 functions as a manual feed tray 272.

Further, the image forming apparatus includes a maintenance and recovering unit 281 for maintaining and recovering a condition of the nozzles of the recording head 234. The maintenance and recovering unit 281 is disposed at a non-printing area at one side in the main scanning direction of the carriage 233. The maintenance and recovering unit 281 includes cap members (hereinafter, the cap member is referred to as "the cap") 282*a* and 282*b* when the caps 282*a* and 282*b* are not distinguished, they are referred to as "the caps") for capping the nozzle surfaces of the corresponding recording heads 234*a* and 234*b;* a wiper blade 283 that is a blade member for wiping the nozzle surface; and an idle discharging receiver 284 for receiving liquid droplets which are discharged during idle discharging in which liquid droplets that do not contribute for recording are discharged to eject ink whose viscosity has been increased.

Further, an idle discharging receiver 288 is disposed at a non-printing area at the other side in the main scanning direction of the carriage 233. The idle discharging receiver 288 is for receiving liquid droplets which are discharged during idle discharging in which liquid droplets that do not contribute for recording are discharged to eject ink whose viscosity has been increased. The idle discharging receiver 288 includes an opening 289 along a direction of the nozzle sequences of the recording head 234.

In the image forming apparatus having such a configuration, the sheets of the paper 242 are separated and fed from the paper feed tray 202 on a sheet-by-sheet basis. The sheet 242 that has been fed substantially vertically upward is guided by the guide 245. The sheet 242 is conveyed, while being nipped between the conveyance belt 251 and the counter roller 246. Further, the tip of the sheet 242 is guided by the conveyance guide 247, and subsequently the tip of the sheet 242 is pressed by the tip pressing roller 249 toward the conveyance belt 251, and thereby the conveyance direction is changed by substantially 90 degrees.

At this time, a voltage in which a plus output and a minus output are alternately repeated, namely, an alternating voltage is applied to the charging roller 256. Consequently, an alternating charge voltage pattern is formed on the conveyance belt 251, namely, a positively charged area having a predetermined width and a negatively charged area having the predetermined width are alternately formed on the conveyance belt 251 in the sub-scanning direction (the circulating direction of the conveyance belt 251). When the sheet 242 is fed onto the alternately charged (positively and negatively charged) transfer belt 251, the sheet 242 is attracted by the conveyance belt 251. Therefore, the sheet 242 is conveyed in the sub-scanning direction by the circulation of the conveyance belt 251.

An amount corresponding to one line is recorded by discharging ink droplets onto the stopped sheet 242 by driving the recording head 234 in accordance with an image signal while moving the carriage 233. Subsequently, the sheet 242 is conveyed by a predetermined amount, and the recording of the next line is performed. The image forming apparatus terminates the recording operation by receiving a recording completion signal or a signal indicating that the end of the sheet 242 has reached the recording area, and the image forming apparatus discharges the sheet 242 onto the paper discharge tray 203.

As described above, since the image forming apparatus includes the liquid discharge head according to one of the embodiments as the recording head, a stable droplet discharging characteristic is obtained. Therefore, a high quality image can be stably formed.

Hereinabove, the liquid discharge head and the image forming apparatus have been explained by the embodiments. However, the present invention is not limited to the above-described embodiments, and various modifications and improvements may be made within the scope of the present invention.

In the above description, the material of "the sheet" is not limited to the paper, and it includes an OHP sheet, a glass, a substrate, and the like. The sheet means something to which ink droplets or other liquids can be adhered. The sheet includes things that are referred to as a medium to be recorded on, a recording medium, a recording paper, and the like. Further, "image formation," "recording," "typing," "copying," and "printing" are regarded as synonyms.

Further, the "image forming apparatus" means a device which forms an image by discharging a liquid onto a medium, such as a paper, a thread, a fiber, a fabric, leather, a metal, a plastic, a glass, a timber, and a ceramic. Further, "forming an image" means not only to add an image having a meaning such as a character or a graphic to a medium, but also to add an image having no meaning such as a pattern to a medium (simply adhering droplets to the medium).

Further, except as indicated otherwise, the "ink" is not limited to something which is commonly referred to as ink. The "ink" is used as a generic term for all liquids with which an image can be formed, such as a recording liquid, a fixing liquid, and things that are referred to as liquids. For example, the "ink" includes a DNA sample, a resist, a pattern material, and a resin.

Further, the image is not limited to a two-dimensionally formed image. The image also includes an image attached to something which is three-dimensionally formed, and an image which has been formed in three dimensions.

Further, except as indicated otherwise, the image forming apparatus includes both a serial type image forming apparatus and a line type image forming apparatus.

The present application is based on Japanese Priority Application No. 2012-027055 filed on Feb. 10, 2012, the entire contents of which are hereby incorporated herein by reference.

What is claimed is:

1. A liquid discharge head comprising:

a nozzle plate including a plurality of nozzles configured to discharge liquid droplets;

a flow channel member configured to form a plurality of individual liquid chambers, the plurality of individual liquid chambers communicating with the corresponding nozzles; and a frame member configured to form a common liquid chamber that supplies a liquid to the plurality of individual liquid chambers, wherein the frame member is configured to cover a first outer circumferential surface of the nozzle plate and a second outer circumferential surface of the flow channel member, wherein the frame member includes a protecting portion that covers a peripheral portion of a surface of the nozzle plate, wherein the protecting portion is configured to be welded to the surface of the nozzle plate, wherein a through hole is formed in the peripheral portion of the surface of the nozzle plate that is covered with the protecting portion, and wherein a pillar integrally formed with the protecting portion penetrates into the through hole, and the through hole is filled with the pillar.

2. The liquid discharge head according to claim 1, wherein a first surface of the protecting portion is inclined such that the first surface is separated from the surface of the nozzle plate in a liquid discharging direction along a first direction from an internal circumferential edge to an outer circumference of the frame member, wherein the internal circumferential edge covers the surface peripheral portion of the nozzle plate.

3. A liquid discharge head comprising:

a nozzle plate including a plurality of nozzles configured to discharge liquid droplets;

a flow channel member configured to form a plurality of individual liquid chambers, the plurality of individual liquid chambers communicating with the corresponding nozzles; and a frame member configured to form a common liquid chamber that supplies a liquid to the plurality of individual liquid chambers, wherein the frame member is configured to cover a first outer circumferential surface of the nozzle plate and a second outer circumferential surface of the flow channel member, wherein the frame member includes a protecting portion that covers a peripheral portion of a surface of the nozzle plate, wherein the protecting portion is made molten and adhered to the surface of the nozzle plate, wherein a through hole is formed in the peripheral portion of the surface of the nozzle plate that is covered with the protecting portion, wherein a plurality of through holes is formed in the surface peripheral portion of the nozzle plate, and wherein the plurality of through holes is arranged in a staggered manner.

4. The liquid discharge head according to claim 1, wherein a first surface of the protecting portion is a or surface.

5. The liquid discharge head according to claim 1, wherein the liquid discharge head is disposed in an image forming apparatus having a wiper member configured to wipe the surface of the nozzle plate, and wherein a first surface of the protecting portion, the first surface being at a side from which the wiper member starts contacting, is inclined such that the first surface is separated from the surface of the nozzle plate in an opposite direction, the opposite direction being opposite to a liquid discharging direction, along a first direction from an internal circumferential edge to an outer circumference of the frame member, wherein the internal circumferential edge covers the surface peripheral portion of the nozzle plate.

6. The liquid discharge head of claim 1, wherein a plurality of through holes is formed in the peripheral portion of the surface of the nozzle plate that is covered with the protecting portion, and wherein the plurality of through holes is arranged in a staggered manner.

7. An image forming apparatus comprising:

a liquid discharge head, wherein the liquid discharge head includes a nozzle plate including a plurality of nozzles configured to discharge liquid droplets;

a flow channel member configured to form a plurality of individual liquid chambers, the plurality of individual liquid chambers communicating with the corresponding nozzles; and a frame member configured to form a common liquid chamber that supplies a liquid to the plurality of individual liquid chambers, wherein the frame member is configured to cover a first outer circumferential surface of the nozzle plate and a second outer circumferential surface of the flow channel member, wherein the frame member includes a protecting portion that covers a peripheral portion of a surface of the nozzle plate, wherein the protecting portion is configured to be welded to the surface of the nozzle plate, wherein a through hole is formed in the peripheral portion of the surface of the nozzle plate that is covered with the protecting portion, and wherein a pillar integrally formed with the protecting portion penetrates into the through hole, and the through hole is filled with the pillar.

8. An image forming apparatus comprising:

a liquid discharge head including a nozzle plate, the nozzle plate including plural nozzles configured to discharge liquid droplets; and a wiper member configured to wipe a surface of the nozzle plate, wherein the liquid discharge head includes a flow channel member configured to form a plurality of individual liquid chambers, the plurality of individual liquid chambers communicating with the corresponding nozzles; and a frame member configured to form a common liquid chamber that supplies a liquid to the plurality of individual liquid chambers, wherein the frame member is configured to cover a first outer circumferential surface of the nozzle plate and a second outer circumferential surface of the flow channel member, wherein the frame member includes a protecting portion that covers a peripheral portion of the surface of the nozzle plate, wherein the protecting portion is configured to be welded o the surface of the nozzle plate, wherein a through hole is formed in the peripheral portion of the surface of the nozzle plate that is covered with the protecting portion, wherein a pillar integrally formed with the protecting portion penetrates into the through hole, and the through hole is filled with the pillar and wherein a first surface of the protecting portion, the first surface being at a side from which the wiper member starts contacting, is inclined such that the first surface is separated from the surface of the nozzle plate in an opposite direction, the opposite direction being opposite to a liquid discharging direction, along a first direction from an internal circumferential edge to an outer circumference of the frame member, wherein the internal circumferential edge covers the surface peripheral portion of the nozzle plate.

* * * * *